US006126049A

United States Patent [19]

Gish

[11] Patent Number: 6,126,049

[45] Date of Patent: Oct. 3, 2000

[54] NON-SLIP CLOTHES HANGERS

[76] Inventor: Donald A. Gish, 807 Lynn Ave., Antioch, Calif. 94509

[21] Appl. No.: 09/369,258

[22] Filed: Aug. 9, 1999

[51] Int. Cl.[7] ..... A47G 25/36; A47G 25/52

[52] U.S. Cl. ..... 223/96; 223/98

[58] Field of Search ..... 223/98, 96, 85, 223/92, 95, 88

[56] References Cited

U.S. PATENT DOCUMENTS

| | | | |
|---|---|---|---|
| 2,023,443 | 12/1935 | Rodgers | 223/98 |
| 2,089,077 | 8/1937 | Todd et al. | 223/98 |
| 3,301,446 | 1/1967 | Braswell | 223/98 |
| 3,347,428 | 10/1967 | Gauthier | 223/98 |
| 5,056,694 | 10/1991 | Michalik | 223/98 |

*Primary Examiner*—Bibhu Mohanty
*Attorney, Agent, or Firm*—Linval B. Castle

[57] ABSTRACT

A conventional plastic clothes hanger has a horizontal bar covered with plastic foam such as polyurethane foam to give it a non-slip surface for hanging trousers and other garments. Several auxiliary clamps are described for cooperating with the foam covered horizontal bars for hanging multi-layers or trousers by the cuffs.

3 Claims, 4 Drawing Sheets

12
72
72
65
66
68
12

72
70
66
65

NON-SLIP CLOTHES HANGERS

BACKGROUND OF THE INVENTION

Slacks are purposely designed long to extend from the waste to the heels. Their length requires that they are stored unfolded by a special hanger that hangs the trousers from the cuffs or, more popularly, folded and hung across the horizontal bar of a conventional clothes hanger. Often the smooth slacks will slip from the horizontal bar so that the hanging of slacks becomes a task of balancing them on the bar. To counteract this tendency, many people and also retail establishments, use special hangers with a double horizontal rod, one bar for suspending the trousers, the other, a resilient rod that is secured at one end to the horizontal bar and clips to it at the other end to lock the suspended slacks between the bar and the rod. These hangers are fairly satisfactory in hanging trousers and slacks securely but causes a marked creasing of the fabric.

This invention is for a very inexpensive hanger for holding folded trousers and slacks, without any danger of slipping of the trouser legs, by covering the horizontal bar with plastic foam, such as polyurethane foam, a common, inexpensive material usually used for insulation or cushion padding and having a non-adhesive cellular structure that will grip the fabric.

With the polyurethane foam attached to the horizontal bar of a conventional clothes hanger, security clips may be added to the hangers for further securing the fabrics. These clips are particularly desirable when cuff-hanging or full length positioning of the trousers are desired.

DESCRIPTION OF THE DRAWINGS

In the drawings which illustrate preferred embodiments of the invention.

DETAILED DESCRIPTION

A conventional clothes hanger is generally molded of plastic in the form of a ¼ inch circular rod having a semicircular hanging hook at the top and having side bars angularly branching out to the ends of a straight horizontal rod or bar which is used to suspend folded trousers or slacks. This invention is for inexpensive methods for preventing the folded slacks from slipping from the horizontal bar of an inexpensive plastic hanger and includes covering an horizontal bar with plastic foam, such as polyurethane foam.

Figure 1:
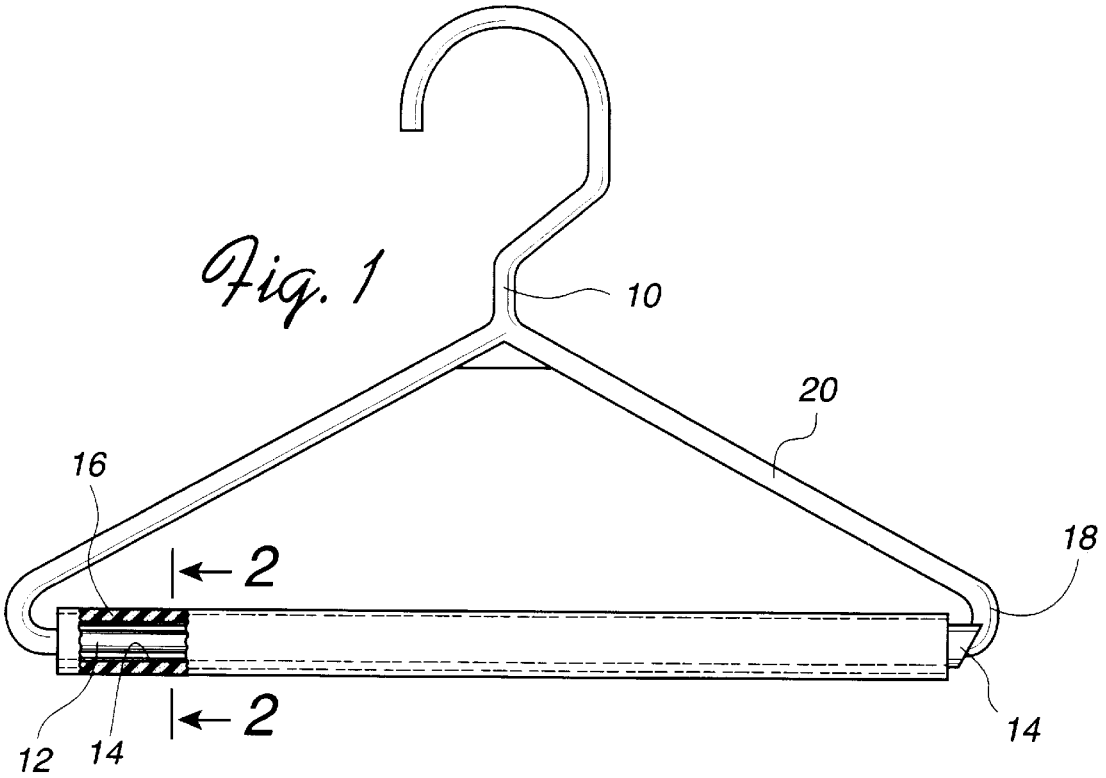
FIG. 1 is a view of a clothes hanger with a plastic foam covered horizontal bar.
Figure 2:
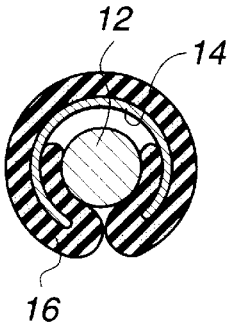
FIG. 2 is a cross section view taken along the lines 2—2 of FIG. 1.

FIG. 1 illustrates a typical plastic hanger 10 with horizontal bar 12 covered with polyurethane foam. A section of the bar 12 is shown in section to illustrate, along with an enlarged cross sectional view of FIG. 2, a preferred method of attachment of a strip of foam to the circular bar. In FIGS. 1 and 2 a length of stiff resilient plastic tubing 14 having a length approximately equal to the length of the horizontal bar 12 and a diameter of about ¾ inch, is longitudinally split over its entire length so that the split may be pried open to expose the interior surface of the tubing. A strip of ½ inch thick foam strip 16 of the same length is wrapped around the exterior of the split tubing 14 and the edges of the foam strip are inserted into the split in the tubing. The horizontal bar 12 of the hanger is then forced into the foam covered split in the tubing 14. If desired, a thinner strip of foam strip 16 may be applied to a horizontal bar 12 by using a split resilient tubing of a smaller diameter.

Continued use with unbalanced loading of a foam covered horizontal bar may result in some rotation of the foam and its split tubing and a possible accidental dropping from the hanger. A simple and effective method of preventing rotation of a foam covering is to extend the split tubing at each end, as shown on the right end of the hanger 10 in FIG. 1, and to notch the ends of the top surface opposite the longitudinal split in the tubing 14 with a notch having a width equal to the diameter of the circular horizontal bar 12. When the split tubing 14 with foam covering 16 is applied to the horizontal bar 12, the two notched ends of the tubing 14 are forced into a non-rotational engagement with the curved section 18 of the hanger between the and arm 20 and the horizontal bar 12.

Figure 3:
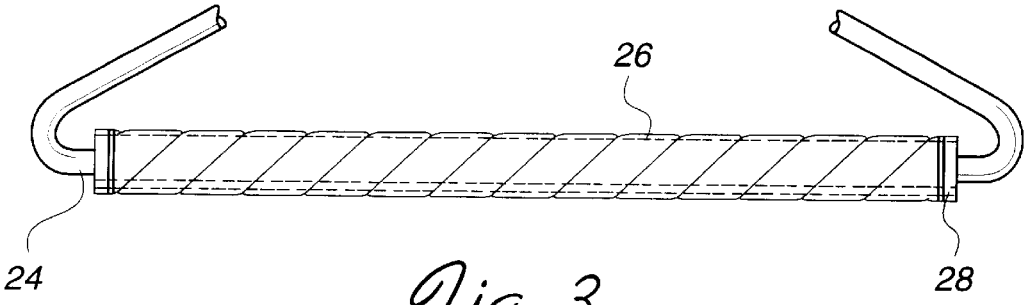
FIG. 3 illustrates a horizontal bar covered with plastic foam tape.

FIG. 3 illustrates the horizontal bar 24 of a clothes hanger wound with strips of plastic foam, such as polyurethane foam 26, that is merely secured at the ends of the form with plastic ties 28. This is a very simple design and does not require a split tubing.

Figure 8:
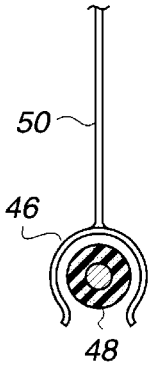
FIG. 8 is an sectional end view taken along the lines 8—8 of FIG. 7.

The preferred method of applying plastic foam to a horizontal bar is to mold a tube of the plastic foam to the desired dimensions. Then split the plastic tube and slip it over the horizontal bar and cement it in place. The cross section view of the plastic foam would appear as in the sectional view of FIG. 8.

Figure 4:
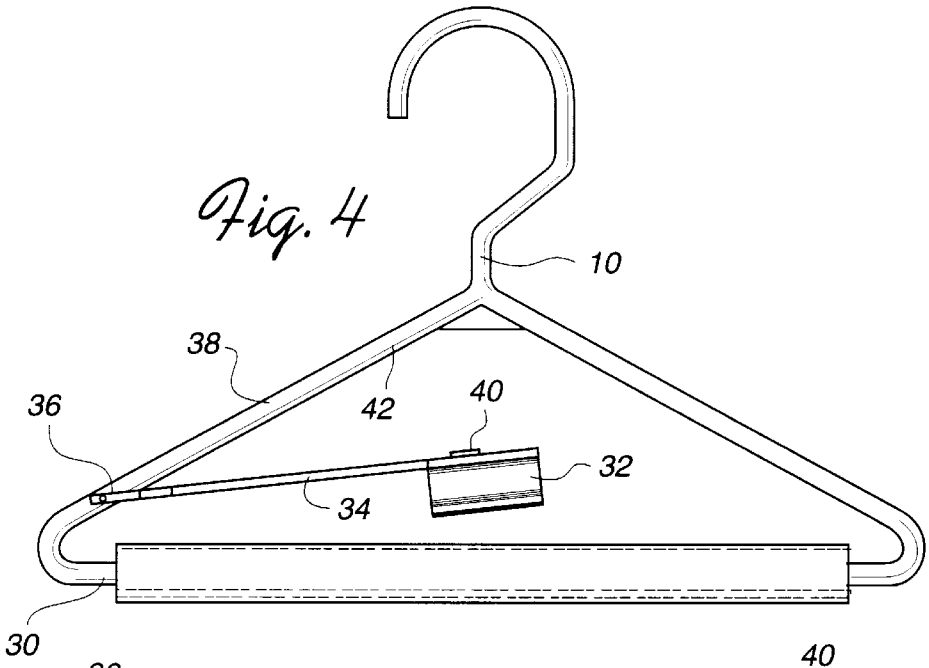
FIG. 4 illustrates a hanger with a clip on a pivoted arm for securing fabrics on the plastic foam covered horizontal bar.
Figure 5:
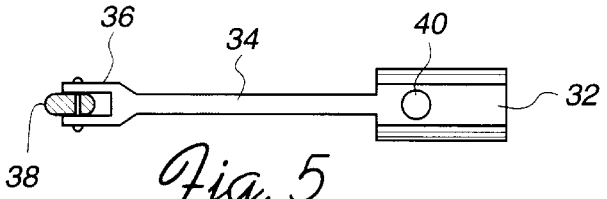
FIG. 5 is a plan view of the clip and arm of FIG. 4.
Figure 6:
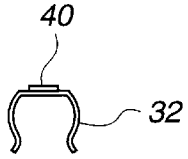
FIG. 6 is an end view of the clip of FIG. 4.

FIG. 4 illustrates a plastic foam covered horizontal bar 30 with an auxiliary security clamp 32 that holds slacks on the bar and is useful in preventing slipping if a full length hanging of two or more pairs of trousers is desired. Clamp 32 is two to three inches in length and shaped similar to an inverted "U", as shown in FIG. 6, so that is loosely fits around the foam covered horizontal bar 30. It is attached to an arm 34 which, at the opposite end, is bifurcated 36 and pivotally pinned to a side arm 38 of a hanger. A small circular magnet 40 is cemented to the top of the arm 34 which magnetically couples to an iron tab 42 on the hanger side arm 38 to hold clamp 32 away from the foam covered horizontal bar 30 during loading of the hanger. Of course, the magnet 40 and tab 42 may be reversed and will operate the same.

Figure 7:
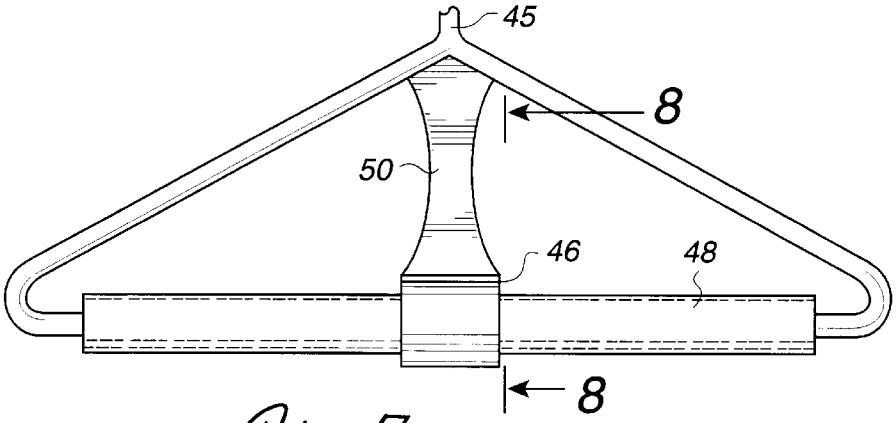
FIG. 7 illustrates a hanger with a clip suspended from on a flexible plastic band.

FIG. 7 illustrates the foam covered horizontal bar 44 of a clothes hanger 45 with a security clamp somewhat similar to the clamp 32 of FIG. 4. In FIG. 7 the inverted "U" shaped clamp 46 loosely fits around the plastic foam covering 48 on the bar 44 as shown in the end view of FIG. 8. The plastic clamp 46 is suspended slightly above the surface of the foam 48 by a thin band of pliable plastic 50, such as polycarbonate, one end of which is cemented to the top exterior surface of the clamp, the opposite end being cemented to the junction of the side arms of the hanger.

Figure 9:
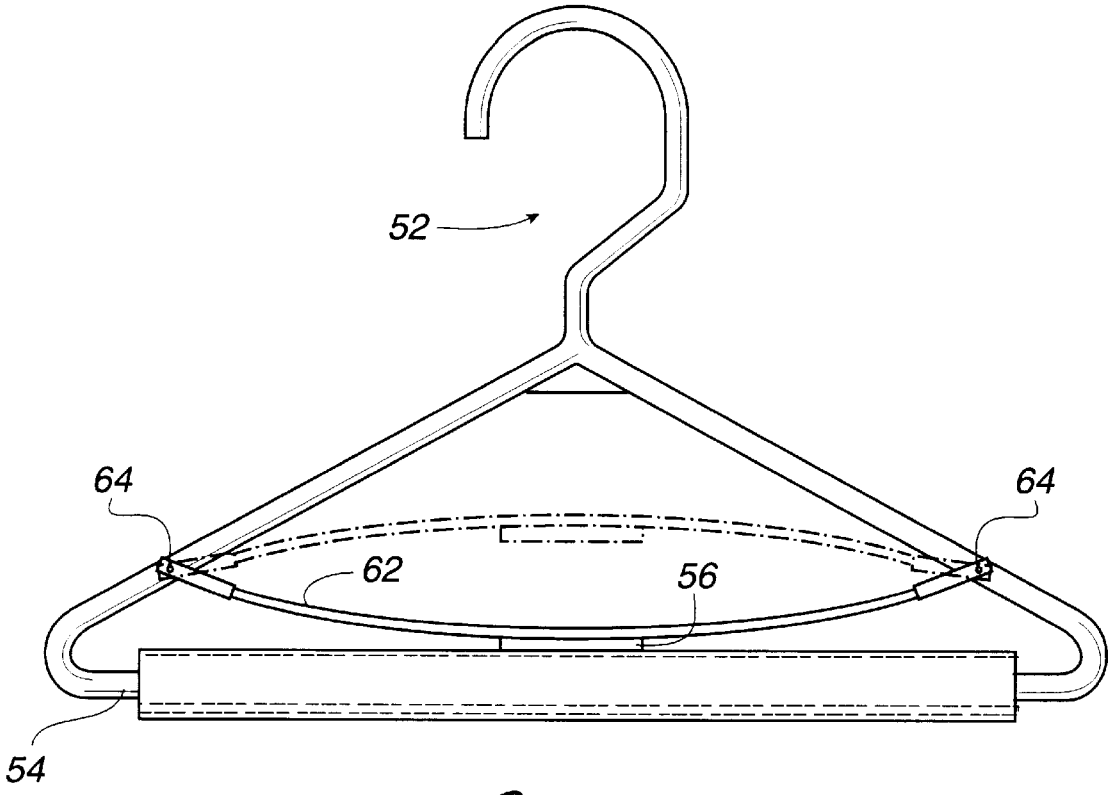
FIG. 9 illustrates a hanger with a pad suspended in the center of a pliable strip pivoted at each end to the frame of the hanger.
Figure 10:
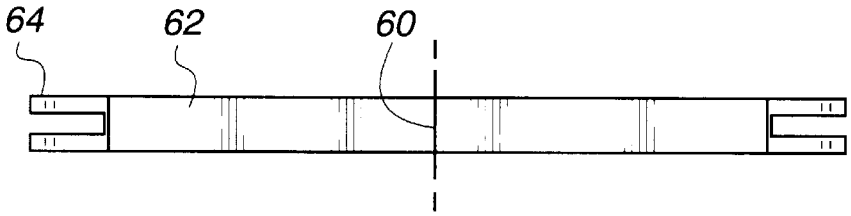
FIG. 10 is a plan view of the pliable strip and pad of FIG. 9.

FIG. 9 illustrates a clothes hanger 52 with a foam covered horizontal bar 54 having an foam security clamp 56 in contact with the top surface of the plastic foam 58 and cemented to the surface of the center 60 of a resilient strip 62 that is bifurcated at both ends as shown in plan view of the strip in FIG. 10. The resilient strip 62 has an overall length, including the bifurcated ends, two to three inches less than the length of the horizontal bar 54 and its bifurcated ends 64 are formed to be pivotally pinned to the side bars of the hanger 52.

The resilient strip 62 is attached to the hanger 52 with the foam surface of the clamp 56 in light contact with the surface of the foam covering 58 at the middle of the horizontal bar 54. Then each bifurcated end 64 of the resilient strip 62 is bent up and pivotally pinned to a side bar of the hanger 52. The resiliency of the strip 62 makes it easy to lift the clamp 56 from the bar; lifting the strip on either side of its center 60 will urge the strip into the form of a "stretched S", causing the strip 62 to spring upward into an arch, shown by the broken lines. The advantage of this type of security clamp is that fabric suspended in the hanger is held by foam from above as well as from below, making it ideal for clamping materials that normally slide such as rayons and silks and when it is desired to hang slacks in a full-length position.

Figure 11:
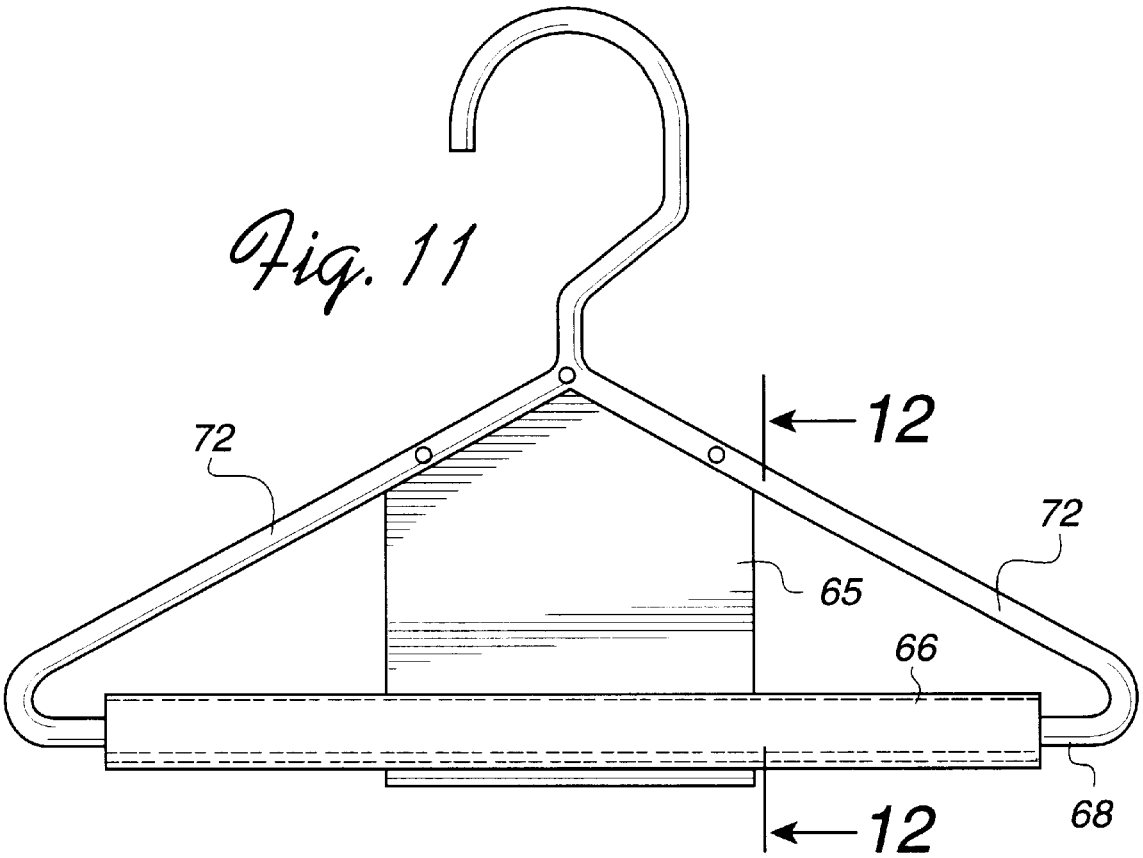
FIG. 11 illustrates a hanger with a pad resiliently pressed against the side of the horizontal bar.
Figure 12:
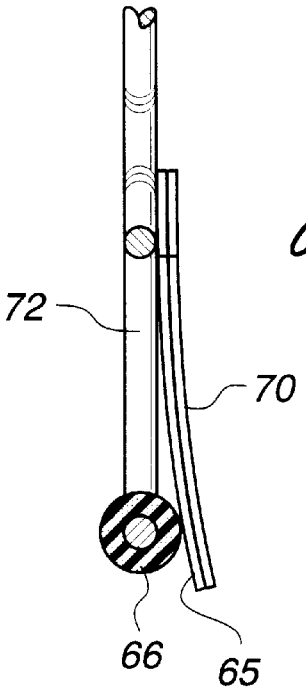
FIG. 12 is a cross sectional view taken across the lines 12—12 of FIG. 11.

FIG. 11 illustrates still another clamp for a clothes hanger with a plastic foam covered horizontal bar. In FIG. 11, a thin pad of foam 65 such as polyurethane foam, is lightly held against the foam covering 66 on the horizontal bar 68 by a plastic sheet backing 70 which is secured to the angularly branching side bars 72 of the hanger near their junction. The width of the foam pad 65 and plastic backing 70 should be at least four inches and its length should extend below the foam covering 66 on the horizontal bar 68 as shown in the sectional view illustrated in FIG. 12. The advantage of this type of security clamp is that slacks and trousers may be easily and very rapidly hung and removed from the cuffs while preserving the crease.

I claim:

1. A method of applying a covering of plastic foam to a straight circular horizontal bar of a molded plastic clothes hanger, said method comprising the steps of:

longitudinally splitting a stiff resilient tubing having a length approximately equal to the length of said horizontal bar and an inside diameter slightly greater than the diameter of said bar;

positioning a sheet of plastic foam on said tubing with the side edges of said foam inserted into said longitudinal split; and forcing said horizontal bar into said longitudinal split with the plastic foam edges.

2. A plastic clothes hanger having a hook coupled to said bars that angularly branch out to the ends of a circular horizontal bar, said clothes hanger including:

a strip of plastic foam around the length of said horizontal bar, said foam being secured to said bar by a split resilient tubing surrounding said bar and gripping the edges of said foam.

3. The plastic clothes hanger claimed in claim 2 wherein the ends of said plastic tubing is notched in the surface opposite said split, said notch fitting into a curved section at the joining of the horizontal bar with a side bar of said hanger and preventing rotation of said tubing.

* * * * *